United States Patent [19]

Konkle

[11] Patent Number: 4,976,204

[45] Date of Patent: Dec. 11, 1990

[54] UTILITY SURFACE SUPPORTING AND STABILITY STRUCTURE

[76] Inventor: Robert E. Konkle, 9893 Weld County Rd., #11, Longmont, Colo. 80501

[21] Appl. No.: 456,182

[22] Filed: Dec. 15, 1989

Related U.S. Application Data

[63] Continuation of Ser. No. 208,234, Jun. 17, 1988, abandoned.

[51] Int. Cl.[5] ..... A47B 23/00

[52] U.S. Cl. ..... 108/43; 248/444; 248/916

[58] Field of Search ..... 108/43, 42, 6, 7; 248/444, 454, 456, 463, 465, 1 B, 916

[56] References Cited

U.S. PATENT DOCUMENTS

| | | | |
|---|---|---|---|
| 1,836,053 | 12/1931 | Wagner | 248/456 |
| 2,471,003 | 5/1949 | Monahan | 108/43 X |
| 2,476,620 | 7/1949 | Nichols | 108/43 X |
| 2,697,018 | 12/1954 | Georgides | 108/43 |
| 3,709,158 | 1/1973 | Kidd | 108/43 |
| 3,730,077 | 5/1973 | Seldon | 108/43 |

*Primary Examiner*—José V. Chen

*Attorney, Agent, or Firm*—Harold A. Burdick

[57] ABSTRACT

A portable supporting and stabilizing structure is disclosed that is particularly well suited for securely maintaining a preselected orientation of a utility surface, such as, for example, a work surface, an equipment mounting surface, or a food tray by, and adjacent to, the thighs of a seated user of the utility surface. The structure includes a supporting section for support of the utility surface and a stabilizing section connected with the supporting section and receivable adjacent to the thighs of a user of the structure so that, when force is exerted by the user's thighs against the stabilizing section of the structure, changes in orientation of the surface are resisted thus securely maintaining the position of the utility surface during use thereof. Structures are disclosed which are collapsible and which are selectively configurable for employing inward or outward exertion of the thighs by the user against the stabilizing section of the structure to stabilize the utility surface.

14 Claims, 5 Drawing Sheets

UTILITY SURFACE SUPPORTING AND STABILITY STRUCTURE

This is a continuation of Ser. No. 07/208,234, now abandoned.

FIELD OF THE INVENTION

This invention relates to supporting and stabilizing structures and, more particularly, this invention relates to portable structures for supporting and stabilizing a utilization area, for example work surfaces, equipment mounting surfaces, food trays and the like.

BACKGROUND OF THE INVENTION

Supporting devices for maintaining trays, work surfaces and the like adjacent to various body members of a user have been heretofore suggested and/or utilized. Examples of such support devices for, at least in part, engaging the outer region of the legs of the user can be found in U.S. Pat. Nos. 1,520,085, 1,546,116, 2,039,922, 2,663,603, 2,750,705, 2,770,514, 2,783,109, and 2,844,429. Examples of such support devices configured to be engaged by the inner region of the legs, and thus held between the thighs of the user, are shown in U.S. Pat. Nos. 2,647,678 and 2,979,990.

Such devices now known and/or utilized have not been found to fully provide stability of the surface to be utilized, particularly when the supporting structure is to be held between the inner thighs of the user, have not proven to be adaptable for a variety of usages thereof, and/or have not provided for adjustment of the surface to accommodate differing modes of utilization. Improvements in such devices are deemed, therefore, to be needed and/or useful.

SUMMARY OF THE INVENTION

This invention provides a supporting and stabilizing structure for securely maintaining a preselected orientation of a utilization area, for example a work surface, adjacent to the thighs of a user which, when held by forces applied by the user's thighs to one portion of the stabilizing structure, resists applied straight line and rotational forces, which is adaptably maintainable adjacent to the inner or outer thigh region of the user, which is lightweight and portable, and/or which provides for adjustment of the position of the work surface relative to a user thereof.

It is therefore an object of this invention to provide a supporting and stabilizing structure for securely maintaining a preselected orientation of a utilization area adjacent to the thighs of a user thereof.

It is another object of this invention to provide a supporting and stabilizing structure securely maintainable adjacent to a user's body by thigh exerted pressure.

It is another object of this invention to provide a utility structure having a stabilizing portion maintainable between the thighs of a seated user thereof.

It is still another object of this invention to provide a utility structure having stabilizing portions which are selectively configurable for stabilization of a utility surface by forces applied by the inner thighs or outer thighs of a seated user against the stabilizing portions depending on the configuration selected.

It is yet another object of this invention to provide a portable utility surface supporting and stabilizing structure securely maintainable between the thighs of a seated user having stabilizing portions which are movable between a surface supporting position extending away from the utility surface and a stored position adjacent to the utility surface.

It is still another object of this invention to provide a utility surface supporting and stabilizing structure having an adjusting mechanism for adjusting the position of the utility surface relative to a user thereof.

It is yet another object of this invention to provide a supporting and stabilizing structure for securely maintaining a utility structure adjacent to the thighs of a user having a stabilizing portion including contoured portions configured to receive different ones of the inner left and right thigh regions of the user, and with the contoured portions having a lower section extending toward the inner thigh region of the user received thereby.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
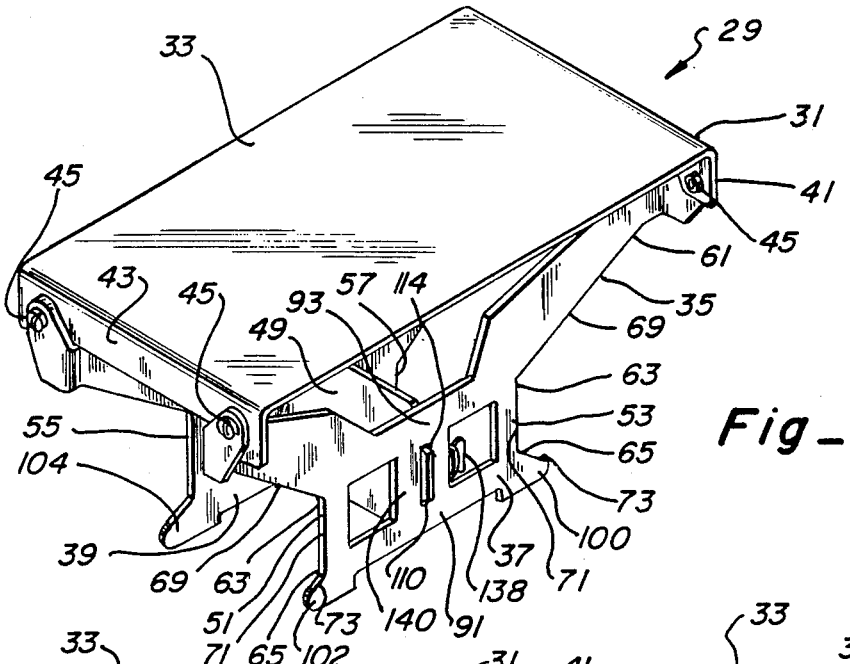
FIG. 1 is a perspective view of a first embodiment of the utility surface supporting and stabilizing structure of this invention.

Referring to the drawings, the now preferred embodiment of the utility surface supporting and stabilizing structure 29 of this invention is shown in FIGS. 1 through 11. As illustrated in FIG. 1, supporting and stabilizing structure 29 includes support section 31 having utility surface 33 defining a utilization area at the upper portion thereof and stabilizing section 35 attached thereto.

Figure 2:
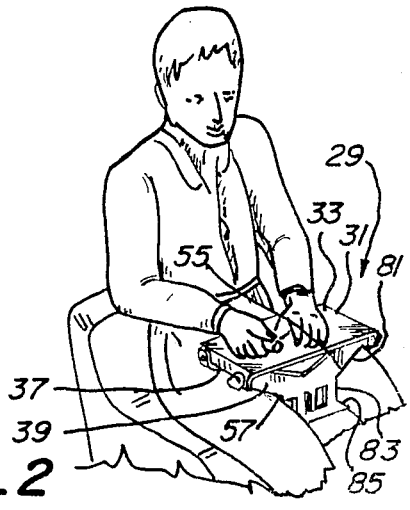
FIG. 2 is a perspective view of the supporting and stabilizing structure of FIG. 1 illustrated in use by being gripped between the thighs of a user of the utility surface supported and stabilized thereby.
Figure 8:
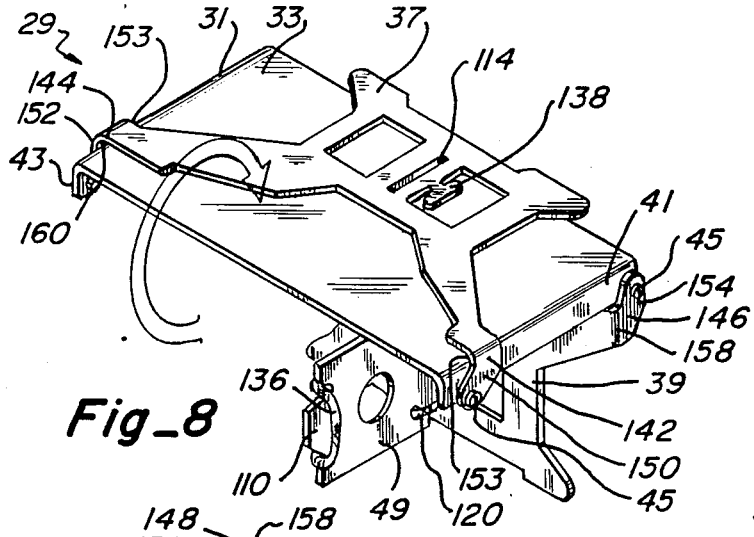
FIGS. 8, 9, and 10 are a series of perspective views of the structure of FIG. 1 illustrating movement of the various sections thereof from operable to stored positions.

Stabilizing section 35 includes forward stabilizing wall portion 37 (positioned nearer the user's upper thigh region as shown in FIG. 2) and rearward stabilizing wall portion 39 (positioned nearer the lower thigh region as shown in FIG. 2) pivotably attached to side walls 41 and 43 of supporting section 31 utilizing, for example, nut, bolt and washer combinations 45. Wall portions 37 and 39 are maintained in their operable position in a spaced, substantially parallel, relationship to each other by position securing member 49.

Figure 3:
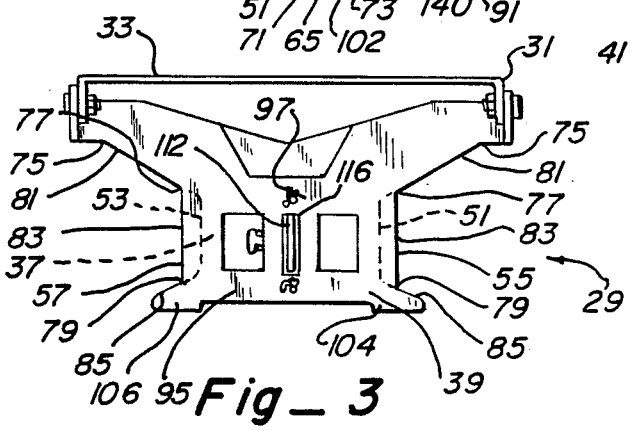
FIG. 3 is a side elevation view of the supporting and stabilizing structure of FIG. 1.
Figure 4:
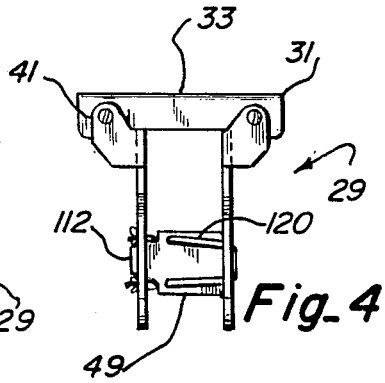
FIG. 4 is an end elevation view of the supporting and stabilizing structure of FIG. 1.
Figure 5:
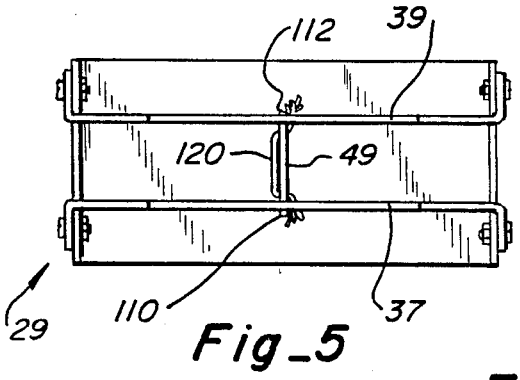
FIG. 5 is a bottom elevation view of the supporting and stabilizing structure of FIG. 1.

As shown in FIGS. 1 through 3, wall portions 37 and 39 each include left and right spaced contoured portions 51, 53, 55 and 57, respectively, which are configured to be comfortably engaged by the thighs of a user so that supporting and stabilizing structure 29 is gripped therebetween thus securely positioning utility surface 33 for use thereof (as illustrated in FIG. 2).

Contoured portions 51 and 53, while facing in opposite directions for receipt of the left and right inner thighs of the user, are substantially identical in configuration, as are contoured portions 55 and 57. Using contoured portion 51 as an example as the description proceeds, and with the understanding that contoured portion 53 is similarly formed, contoured portion 51 is formed by angles 61, 63 and 65 and upper contour section 69, middle contour section 71 and lower contour section 73. Likewise, using contour portion 55 as an example of the formation of contoured sections 55 and 57, contoured section 55 is formed by angles 75, 77 and 79 and upper contour section 81, middle contour section 83 and lower contour section 85.

As suggested by FIG. 2, middle sections 71 and 83 are received adjacent the inner thighs of the user, with middle sections 71 being received adjacent the upper distal medial thigh region of the user's legs, and with middle sections 83 being received adjacent to the lower distal medial thigh region. Lower sections 73 and 85 extend from middle sections 71 and 83, respectively, toward the inner thigh region of the user, while upper sections 69 and 81 extend over the thigh region of the user, so that, in combination with angles 61, 63, 65, 75, 77, and 79, the contoured sections are nested comfortably into the distal medial thigh region of the left and right legs of the user supporting the structure.

All four contoured portions 51, 53, 55 and 57 are similar in that angles 63 and 65, and angles 77 and 79, are approximately at 120° angles with reference to middle sections 71 and 83, thus allowing the thighs of a wide range of morphology to comfortably conform to the contoured portions of any one structure in order to firmly grip the structure and thus stabilize utility surface 33.

The actual lengths of upper sections 69 and 81, middle sections 71 and 83, and lower sections 73 and 85 may, of course, be varied in production to accommodate different thicknesses of thighs of users, and to provide for different relative lengths of middle sections 71 and 83, with middle section 71 being greater in length than middle section 83, if desired, to accommodate the difference in thickness of the upper and lower thigh region of a user (also, thereby, necessitating some variation in the angles utilized to form the contoured portions).

Contoured portions 51 and 53 are separated by wall sections 91 and 93, and contoured portions 55 and 57 are separated by wall sections 95 and 97. The distance between contoured portions 51 and 53, as determined by wall sections 91 and 93 will generally be less than the distance between contoured portions 55 and 57 as determined by wall sections 95 and 97 in order to accommodate the greater distance between the upper thigh region and lower thigh region of the user.

The vertical dimensions of wall sections 91 and 95 are preferably of such a length that wall portions 37 and 39 do not touch the chair or other seating mechanism of the seated user of the structure, and may be of different relative lengths in order for utility surface 33 to remain parallel with the lap of the seated user of the structure.

The structure as above-described is configured for utilization of the bilateral adduction forces generated by the legs of the seated user to grip the structure and thus stabilize the utility surface. However, wall portions 37 and 39 may also include foot sections 100, 102, 104 and 106 for supporting the structure when standing alone (thereby allowing the structure to also be utilized as a stool for example).

The distance between wall portions 37 and 39 effects the degree of rotational stability of the structure as it is gripped between the thighs of the user, and adjusting mechanisms (as shown hereinafter) can be provided for adjustment of the distance between the wall portions.

As shown in FIGS. 1 through 7, the operable positioning of wall portions 37 and 39 is maintained by position securing member 49 which includes forward and rearward tongues 110 and 112 for receipt through apertures 114 and 116 in wall portions 37 and 39, respectively.

Tongues 110 and 112 are firmly, yet releasably, maintained in apertures 114 and 116, thereby maintaining wall portions 37 and 39 in alignment for receipt between the thighs of a user, by resilient cord member 120.

Cord member 120 is threaded at its opposite ends through apertures 124 and 126 in wall portion 39, and ends are knotted at the outward face of wall portion 39 to prevent movement thereof through apertures 124 and 126. Apertures 124 and 126 are positioned directly above and directly below, respectively, aperture 116. Cord member 120 is maintained through apertures 128 and 130 in position securing member 49 adjacent wall portion 39 and through slots 132 and 134 in position securing member 49 adjacent wall portion 37.

When tongues 110 and 112 are positioned through apertures 114 and 116 loop section 136 of cord member 120 is stretched and positioned over ear 138 extending from wall section 140 of wall portion 37. The overall length of cord member 120 is such that when loop section 136 thereof is stretch over ear 138 cord member 120 is taut thus urging tongues 110 and 112 into apertures 114 and 116 and, thereby, wall portions 37 and 39 into firm engagement with position securing member 49.

Turning now to FIGS. 8 through 11, movement of wall sections 37 and 39 and position securing member 49 from their operable, engaged positions (as shown in FIG. 1) to their stored positions is illustrated. Wall portions 37 and 39 each include pivotable angled attachment sections 142 and 144 and 146 and 148, respectively. Angled attachment sections 142 and 144 are formed by sections 150 and 152 and 90° angle 153 and angled attachment sections 146 and 148 are formed by sections 154 and 156 and 90° angle 158. Sections 154 and 156 are of greater length between the point of attachment at bolts 45 and 90° angle 158 than is the length of sections 150 and 152 between the point of attachment at bolt 45 and 90° angle 153 (with the difference in length being approximately equal to the thickness of the material being used to construct wall portions 37 and 39).

As illustrated, loop section 136 is released from ear 138, thus releasing tongue 110 from aperture 114. Wall portion 37 is then pivoted outwardly on nut, bolt and washer combinations 45 until wall portion 37 is resting upon utility surface 33, with the upper edge of side walls 41 and 43 nested in angled sections 142 and 144, respectively.

Figure 9:
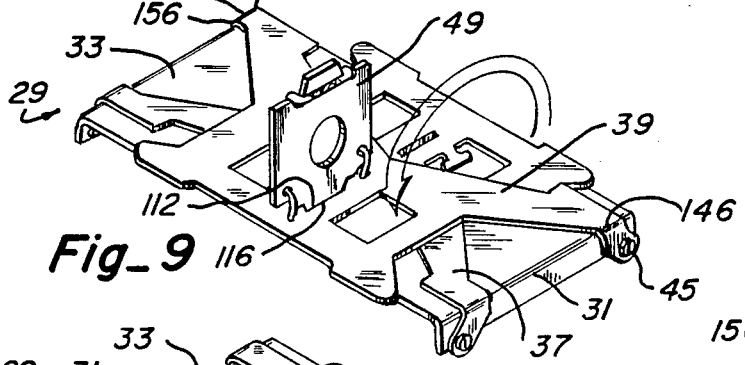
Figure 11:
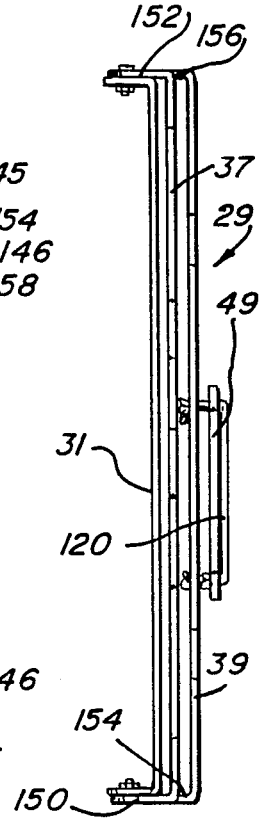
FIG. 11 is a sectional view of the structure of FIG. 1 in its stored position taken along section line 11—11 of FIG. 10.
Figure 10:
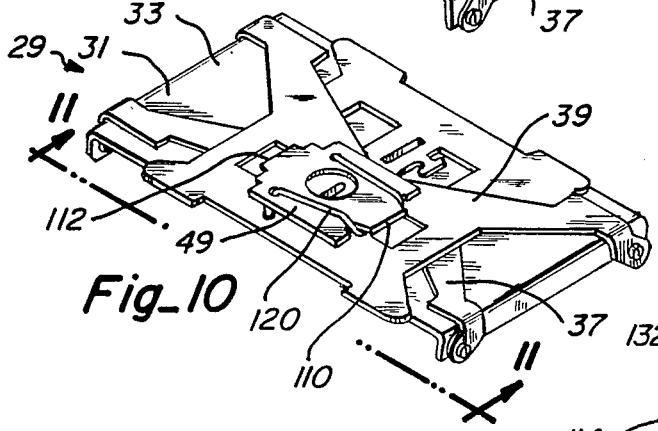
Figure 7:
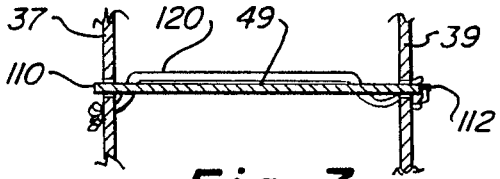
FIG. 7 is a sectional view of the section of the structure of FIG. 6 taken along section line 7—7.
Figure 6:
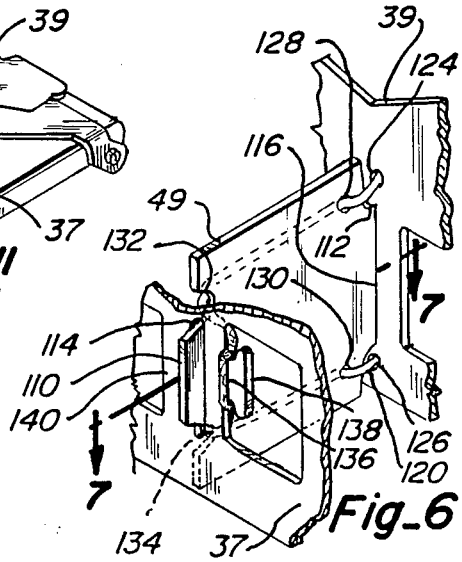
FIG. 6 is a partial perspective view of a portion of the supporting and stabilizing structure of FIG. 1 particularly illustrating the section of the structure for securing the position of the utility surface support and stabilizing walls.

As shown in FIG. 9, wall section 39 may then be pivoted outwardly around nut, bolt and washer combinations 45 until wall section 39 is resting on wall section 37. As illustrated in FIGS. 10 and 11, position securing member 49 may then be pulled upwardly, thus releasing tongue 112 from aperture 116 so that position securing member 49 may be lain atop wall portion 39, being urged to remain in this position by further contraction of cord member 120.

Turning now to FIGS. 12 through 16, a second embodiment of the supporting and stabilizing structure of this invention 170 is shown which is similar in many regards to the structure shown in FIGS. 1 through 11, particularly with respect to contoured portions 51, 53, 55 and 57.

Figure 13:
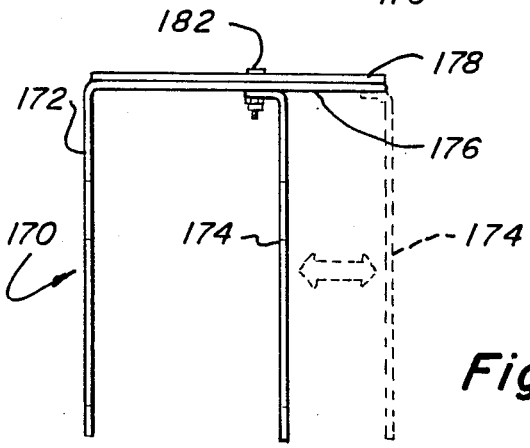
FIG. 13 is an end elevation view of the structure of FIG. 12.
Figure 17:
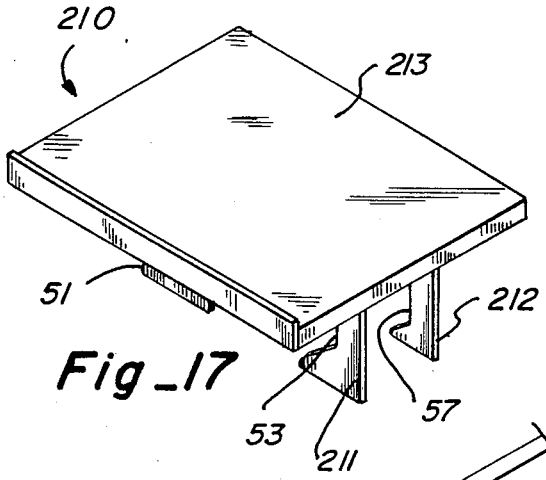
FIG. 17 is a perspective view of a third embodiment of the supporting and stabilizing structure of this invention.

Structure 170 includes stabilizing wall portions 172 and 174, with stabilizing wall portion 172 being affixed to support portion 176 having work surface 178 positioned at the upper portion thereof. Wall portion 174 is slidably affixed to support section 176, with rail 180, attached to wall portion 174, being slidably attached by nut, bolt and washers arrangements 182 through elongated apertures 184 to support portion 176. By loosening of the nuts in nut, bolt and washer arrangements 182, the distance of wall portion 174 from wall portion 172 may be adjusted for storage and/or for comfort and maximum stability of the structure when in use (as illustrated in FIG. 13).

Figure 14:
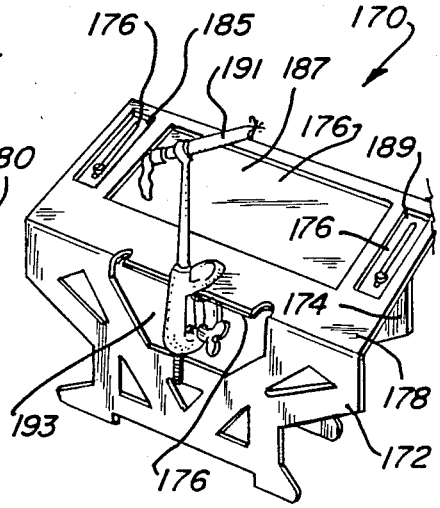
FIG. 14 is a perspective view of the structure of FIG. 12 illustrating the structure in an upright position and used in association with a tool.

By providing separate work surface 178, cutout areas thereof, such as cutout area 185, 187 and 189 shown in FIG. 14, may be provided thus creating storage areas for maintaining various items used in association with the structure, as well as providing a firmer, reinforced, work surface for attachment of various utility structures, such as fly tying vise 191 shown in FIG. 14. Cutout portion 193 in wall portion 172 is provided to allow space for attachment of such utility structures. (While a fly tying vise 191 is shown herein, it should be understood that any number of attachment arrangements for utility structures, for example typewriters, computing and/or word processing devices and the like could be provided for at the utility surfaces of the various embodiments of the invention shown in the drawings).

Figure 15:
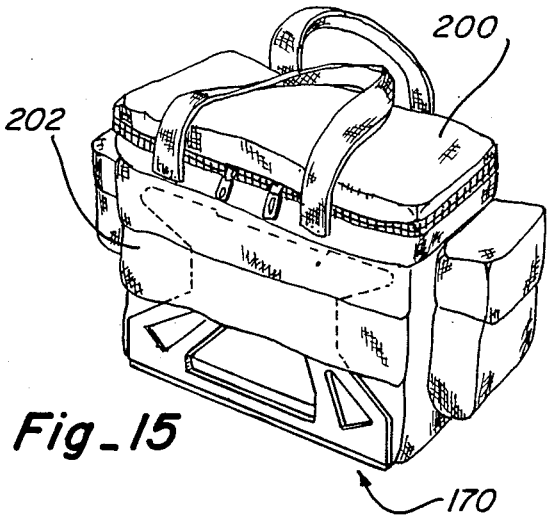
FIG. 15 is a partial perspective view of the structure of FIG. 12 illustrating storage thereof in a bag structure.
Figure 16:
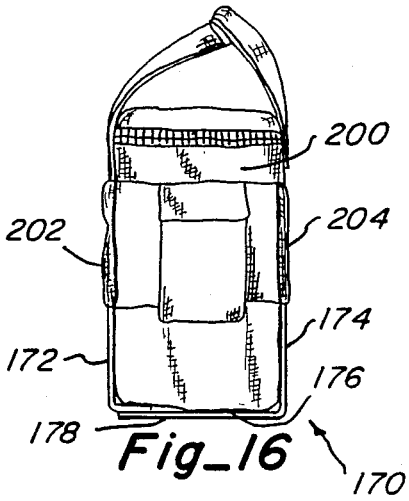
FIG. 16 is an end elevation view of the stored structure of FIG. 15.
Figure 12:
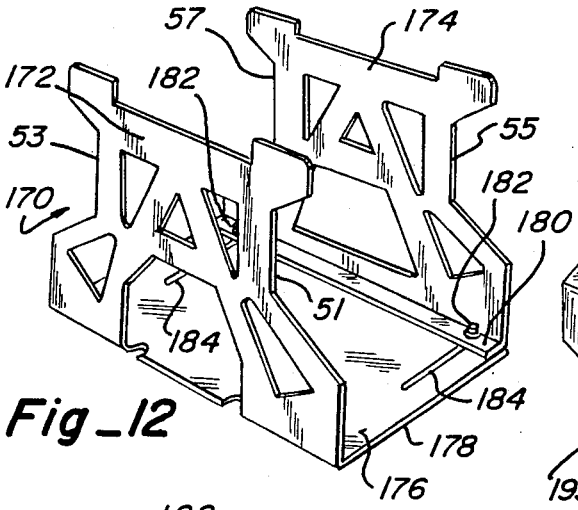
FIG. 12 is a perspective view of a second embodiment of the supporting and stabilizing structure of this invention

While the embodiment shown in FIGS. 12 through 16 is not collapsible, it is particularly well suited to carriage in a bag structure 200 as illustrated in FIGS. 15 and 16. Pockets 202 and 204 opening toward the bottom of the bag structure are provided on either side thereof, and are of a size to snugly receive wall portions 172 and 174 therein so that bag structure 200 is nested between wall portions 172 and 174 and resting against support section 176 thereby providing a compact portable system.

Figure 18:
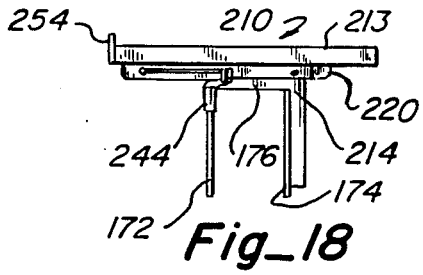
FIG. 18 is an end elevation view of the structure of FIG. 17 particularly illustrating the mechanism for adjustment of the utility surface thereof.
Figure 19:
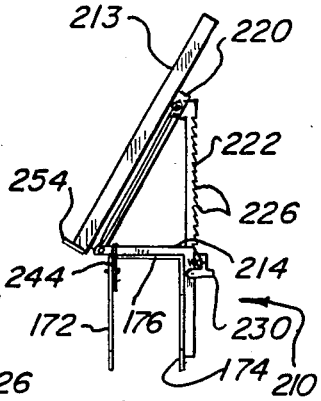
FIG. 19 is an end elevation view of the structure of FIG. 17 showing the utility surface in a raised position.
Figure 20:
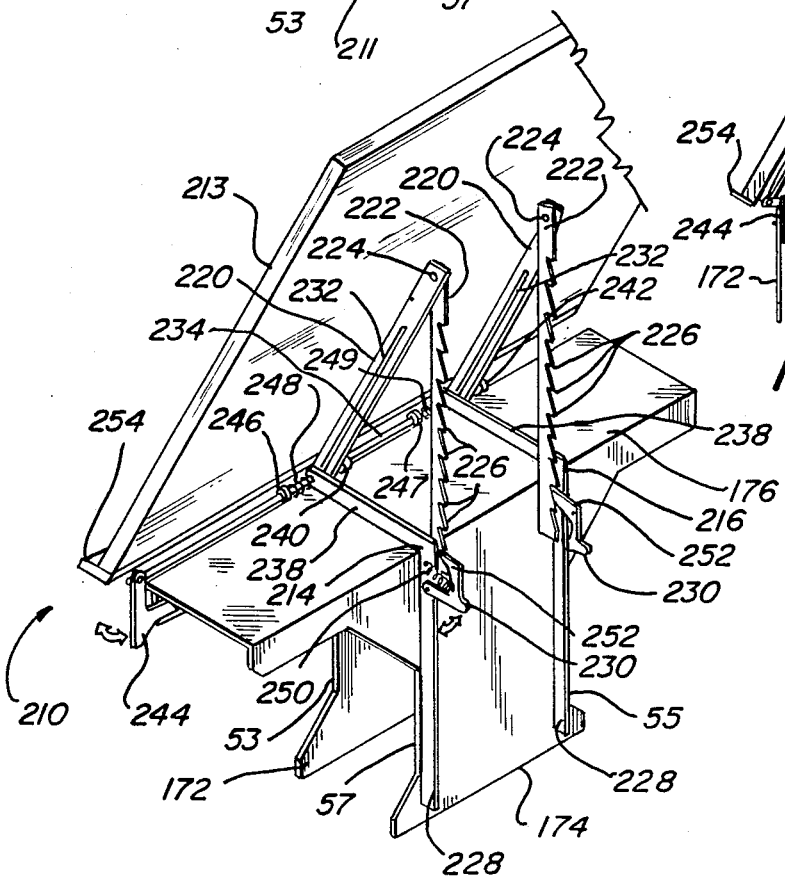
FIG. 20 is a perspective view of the structure of FIG. 17 showing the utility surface in a raised position.
Figure 21:
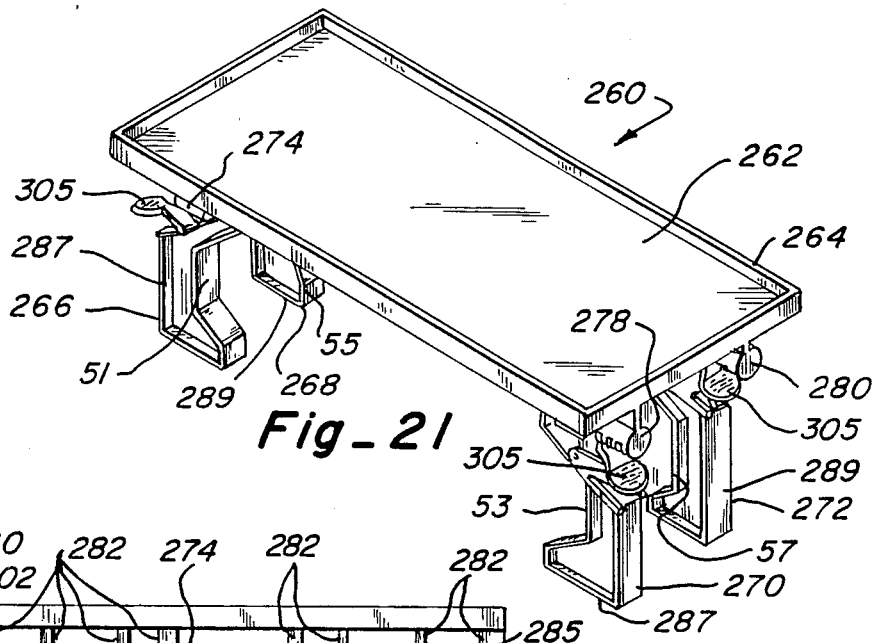
FIG. 21 is a perspective view of a fourth embodiment of the supporting and stabilizing structure of this invention.

A third embodiment of the supporting and stabilizing structure 210 is illustrated in FIGS. 17 through 20. Support and stabilizing structure 210 is similar in many regards to the structures shown in FIGS. 1 and 12, again particularly with regard to contoured portions 51, 53, 55, and 57 of stabilizing wall portions 172 and 174 (as shown in FIGS. 18 through 20) or stabilizing wall portions 211 and 212 (shown in FIG. 17 and configured for receipt over the outer thigh region as more fully set forth hereinafter).

However, this embodiment of the device is provided with a mechanism for adjusting work surface 213. Support section 176 and wall portion 174 are provided with height adjustment mechanisms 214 and 216. Adjustment mechanisms 214 and 216 are similar in many regards, and using height adjustment mechanism 214 as an example, include slide rail assembly 220 mounted to work surface 213, lift bar 222 pivotably attached to rail 220 at pivot pins 224 and having ratchet teeth 226 thereon, guide rail 228, and biased pawl 230. Slide rail 220 includes elongated aperture 232 for movement therethrough of shaft 234 maintained adjacent to support section 176 through mounting rail 238.

Shaft 234 includes nuts 240 and 242 firmly affixed to the shaft adjacent to one side of each slide rail 220 and clamping mechanism 244 affixed to one end thereof. Spring retaining nuts 246 and 247 are firmly affixed on the opposite sides of mounting rails 238 on shaft 234 from slide rail 220. Springs 248 and 249 are positioned on shaft 234 between retaining nuts 246 and 247 and mounting rails 238. By moving clamping mechanism 244 to its downward, or locked, position, slide rails 220 are clamped between mounting rails 238 and nuts 240 and 242 thereby stabilizing work surface 213. Movement of mechanism 244 to its upward position releases rails 220 for adjustment of surface 213.

Pawls 230 include biasing springs 250 for manual release of engaging finger 252 from ratchet teeth 226 for raising or lowering of work surface 213. Work surface 213 may desirably include a lip 254 for maintaining work utensils thereat.

While height adjusting mechanisms 214 and 216 are shown, many other such devices for adjusting height and/or tilt of surfaces could be utilized as are well known in the art, and height adjustment mechanisms could be provided at both wall portions 172 and 174 for adjustment of the overall height of the work surface 213 and/or for leveling the work surface.

FIGS. 21 through 25 illustrate a fourth embodiment of supporting and stabilizing structure 260. Structure 260 includes support section 262 having a retaining wall 264 around the edges thereof. Independently movable supporting portions 266, 268, 270 and 272 are mounted on mounting shafts 274, 276, 278 and 280 mounted on mounting brackets 282 (shafts 274 and 278) and 284 (shafts 276 and 280). Support portions 266 through 272 include contour portions 51, 53, 55 and 57 as heretofore described.

Figure 22:
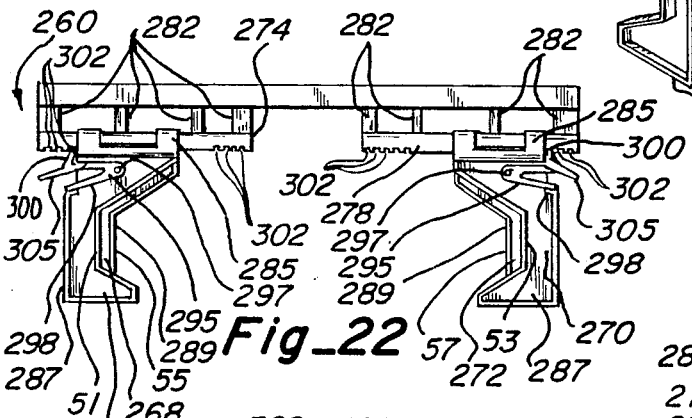
FIG. 22 is a side elevation view of the structure of FIG. 21 illustrating positioning of the support and stabilizing sections thereof for receipt outwardly of the thighs of a user of the structure.
Figure 23:
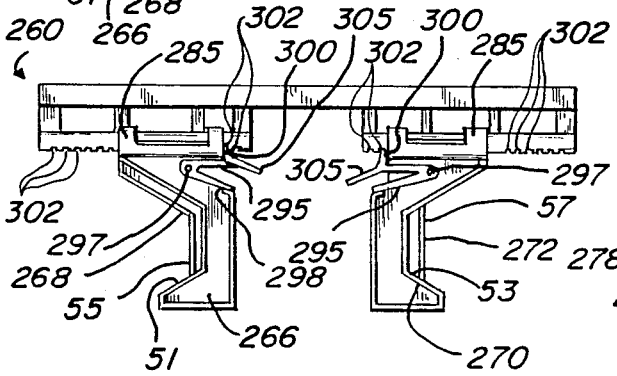
FIG. 23 is a side elevation view of the structure of FIG. 21 illustrating positioning of the support and stabilizing sections thereof for receipt inwardly of the thighs of a user of the structure.

Stabilizing portions 266 through 272 are removable from shafts 274 through 280 for positioning thereon so that contoured portions 51 through 57 face either inwardly (for receipt in the contoured portions of the outer thigh regions of a user of the device for stabilizing structure 260 by adduction forces generated by the legs of a seated person, as shown in FIG. 22), or for outward positioning of the contoured portions (as shown in FIG. 23) for use as heretofore described.

Figure 24:
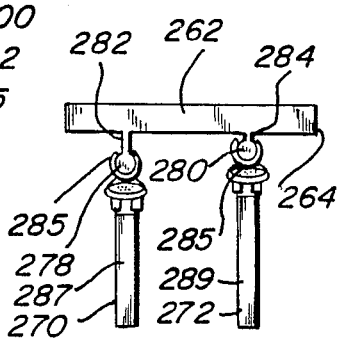
FIG. 24 is an end elevation view of the structure of FIG. 21.

The stabilizing portions are slidably secured on shafts 274 through 280 by mounting barrels 285 which are slidably mounted over rods 274 through 280 (as illustrated in FIG. 24). Barrels 285 are attached to legs 287 and 289, with legs 287 being shorter than legs 289 to accommodate storage of the legs in a collapsed position as illustrated in FIG. 25.

The position of barrels 285 on rods 274 through 280 is adjustable (both for purposes of adjusting spacing for receipt by the outer thighs of the user or the inner thighs of the user, and for adjusting the separation of the contoured portions for increased comfort and maximum efficiency) by provision of spring clips 295 mounted by pins 297 in retainers 298 in legs 287 and 289 (only mounting on legs 287 is illustrated herein in FIGS. 22 and 23, similar structure being employed for mounting hereof on legs 289). The clips are arranged on legs 287 and 289 so that pawl 300 is urged into the selected one of detents 302 and retractable therefrom (for adjustment or removal of stabilizing portions 266 through 272) by depression of spring-biased lever arms 305.

Figure 25:
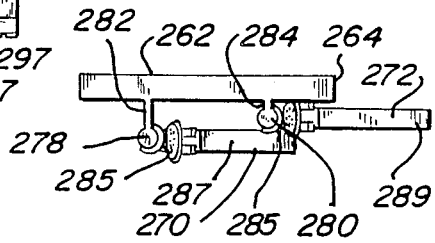
FIG. 25 is an end elevation view of the structure of FIG. 21 illustrating positioning of the support and stabilizing sections thereof in a stored position.

As illustrated in FIGS. 24 and 25 stabilizing portions 266 through 272 may be rotated on rods 274 through 280 (by depression of levers 305) between operable and stored positions.

All portions of the structure herein disclosed may be made of a variety of materials including wood, plastic, metal and the like, and some of the structures herein disclosed may be appropriately constructed of disposable materials, such as paper, cardboard, compressed paper board and the like.

As may be appreciated from the foregoing, a supporting and stabilizing structure for securely maintaining a utility surface adjacent to a user of the utility surface is provided wherein the structure is stabilized by forces applied by the legs of the user of the device, wherein the utility surface may be maintained in a selected attitude for use thereof and which may be collapsed for storage and portability of the structure.

What is claimed is:

1. A supporting and stabilizing structure for securely maintaining a preselected orientation of a utilization area adjacent to the left and right legs of a user of the utilization area, the user's legs each having an inner thigh region, said supporting and stabilizing structure comprising:

support means for supporting a utility surface located at said utilization area, said support means including a forward edge and a rearward edge and left and right lateral edges extending between said forward and rearward edges, said left and right edges being adjacent to different ones of the left and right legs of a user when said preselected orientation of said utilization area is maintained;

a first stabilizing wall having an upper part and first and second sides and being connected to said forward edge of said support means so that said upper part of said first stabilizing wall extends substantially entirely between said left and right edges of said support means, said first and second sides of said first stabilizing wall each including a contoured portion, said contoured portions being substantially unyielding in directions toward and away from each other, each of said contoured portions having a lower contour section, a central contour section and an upper contour section between said central contour section and said upper part of said first stabilizing wall, said lower contour sections extending from said central contour sections in directions having a component away from each other;

a second stabilizing wall having an upper part and first and second sides and being connected with said rearward edge of said support means so that said upper part of said second stabilizing wall extends substantially entirely between said left and right edges of said support means, said first and second sides of said second stabilizing wall each including a contoured portion that includes a lower contour section, a central contour section and an upper contour section between said central contour section and said upper part of said second stabilizing wall, said lower contour sections thereof extending from said central contour sections thereof in directions having a component away from each other, said first and second stabilizing walls being connected with said support means so that a constant substantially perpendicular orientation relative to said utility surface, and a substantially parallel orientation relative to each other, is maintained.

2. The supporting and stabilizing structure of claim 1 wherein said support means and said second stabilizing wall includes cooperative adjusting means for adjusting the distance between said first and second walls while maintaining said substantially parallel orientation therebetween.

3. The supporting and stabilizing structure of claim 1 wherein said contoured portions of said second stabilizing wall are spaced apart a distance greater than said contoured portions of said first stabilizing wall.

4. The supporting and stabilizing structure of claim 1 further comprising position adjusting means connected between said support means and at least one of said stabilizing walls for adjusting the position of said support means relative to a user of said utility surface.

5. A utility structure securely maintainable in a preselected orientation adjacent to the left and right thighs of a user thereof, the user's thighs each having an inner and an outer thigh region, said utility structure comprising:

at least first and second stabilizing means each including a mounting portion and a contoured portion defining a recessed area;

utilization area defining means including a forward edge, a rearward edge and left and right lateral edges extending between said forward and rearward edges, said left and right edges being adjacent to different ones of the left and right thighs of a user when said preselected orientation is maintained; and engaging means connected to said utility surface defining means and configured for slidably receiving said mounting portions of said first and second stabilizing means thereon for selectively positioned engagement and securement of said first and second stabilizing means and said utilization area defining means relative to one another, with said preselected orientation of said utility structure being maintainable by outward pressure of the left and right outer thighs of a user against different ones of said contoured portions of said first and second stabilizing means when said mounting portions of said first and second stabilizing means are slidably received on said engaging means in first preselected relative positions with said recessed areas defined by said contoured portions of said first and second stabilizing means turned toward one another, and with said preselected orientation of said utility structure being maintainable by inward pressure of the inner thighs of a user against different ones of said contoured portions of said first and second stabilizing means when said mounting portions of said first and second stabilizing means are slidably received on said engaging means in second preselected relative positions with said recessed areas defined by said contoured portions of said first and second stabilizing means turned away from one another.

6. The utility structure of claim 5 wherein said mounting portions of said first and second stabilizing means include position selection means for allowing movement of said mounting portions of said first and second stabilizing means in directions toward and away from one another and between stabilizing and stored positions.

7. The utility structure of claim 5 further comprising third and fourth stabilizing means positionable on said engaging means and each having a contoured portion selectively positionable in said first and second preselected relative positions.

8. The utility structure of claim 7 wherein said stabilizing means each include position selection means for adjustment of the relative positions of said contoured portions.

9. A portable utility surface supporting and stabilizing structure securely maintainable in a preselected orientation between the left and right inner thighs of a seated user of the utility surface, said structure comprising:

utility surface defining means for providing said utility surface adjacent to one side thereof and including a forward edge, a rearward edge and left and right lateral edges extending between said forward and rearward edges;

first stabilizing means movably connected with said utility surface defining means and including first and second contoured portions and a first central wall section between said contoured portions, said first and second contoured portions defining first and second recessed areas, respectively, at opposite sides of said first wall section with said first and second recessed areas facing away from one another, said first stabilizing means including connecting means for pivotably connecting said first stabilizing means with said utility surface defining means to allow movement between a first securable position whereat said first central wall section of said first stabilizing means extends substantially perpendicularly relative to said utility surface defining means and a second position whereat said first central wall section of said first stabilizing means is positioned substantially parallel relative to said utility surface defining means;

second stabilizing means movably connected with said utility surface defining means and including third and fourth contoured portions and a second central wall section between said third and fourth contoured portions, said third and fourth contoured portions defining third and fourth recessed areas, respectively, at opposite sides of said second wall section with said third and fourth recessed areas facing away from one another, said second stabilizing means including connecting means for pivotably connecting said second stabilizing means with said utility surface defining means to allow movement between a first securable position whereat said second central wall section of said second stabilizing means extends substantially perpendicularly relative to said utility surface defining means and a second position whereat said second central wall section of said second stabilizing means is positioned substantially parallel relative to said utility surface defining means; and position securing means releasably engageable between said first and second wall sections of said first and second stabilizing means for securing the position of said first and second stabilizing means when said stabilizing means are in said first position.

10. The structure of claim 9 wherein said third and fourth contoured portions of said second stabilizing means are spaced apart a distance greater than said first and second contoured portions of said first stabilizing means.

11. The structure of claim 9 wherein said utility surface defining means includes means for holding various articles utilized by a user of said utility surface.

12. The structure of claim 9 wherein said utility surface defining means includes a raised retaining rim portion around said one side thereof and surrounding said utility surface.

13. The structure of claim 9 wherein said utility surface defining means include at least a first reinforced portion for mounting a utility structure thereat usable with said utility surface.

14. The structure of claim 9 wherein said structure is made of one of lightweight plastic, paper, and compressed paper board material.

* * * * *